United States Patent [19]

Hardman

[11] 4,389,033

[45] Jun. 21, 1983

[54] BROKEN RAIL/BOND DETECTORS

[75] Inventor: Arthur R. Hardman, Cheshire, England

[73] Assignee: GEC-General Signal Limited, Hertfordshire, England

[21] Appl. No.: 251,849

[22] Filed: Apr. 8, 1981

[30] Foreign Application Priority Data

Apr. 8, 1980 [GB] United Kingdom ..... 8011539

[51] Int. Cl.[3] ..... B61L 21/00; G08B 21/00

[52] U.S. Cl. ..... 246/37; 246/28 F; 340/47

[58] Field of Search ..... 246/37, 28 F, 28 K, 246/28 R; 340/47, 540, 652

[56] References Cited

U.S. PATENT DOCUMENTS

| | | | |
|---|---|---|---|
| 1,667,577 | 4/1928 | Wallace | 246/37 |
| 1,868,490 | 7/1932 | Baughman | 246/37 |
| 2,098,833 | 11/1937 | Peter | 246/37 |
| 2,357,236 | 8/1944 | Thompson | 246/37 |
| 2,393,136 | 1/1946 | Bettison | 340/47 |
| 4,117,463 | 9/1978 | Norton | 340/652 |

*Primary Examiner*—Glen R. Swann, III

*Attorney, Agent, or Firm*—Pollock, Vande Sande & Priddy

[57] ABSTRACT

A track circuit receiver is driven by the signal across an impedance bond and operates a relay to disconnect the signal so causing the relay to cycle. In series with the receiver input is a signal from the center tap of the impedance bond, which is normally at earth potential and does not affect the relay cycling. In the event of a rail break a significant output is obtained from the center tap, which either cancels or replaces the original receiver input signal but on a permanent basis uncontrolled by the relay. The relay therefore ceases to cycle in either event and thus provides a break indication.

7 Claims, 1 Drawing Figure

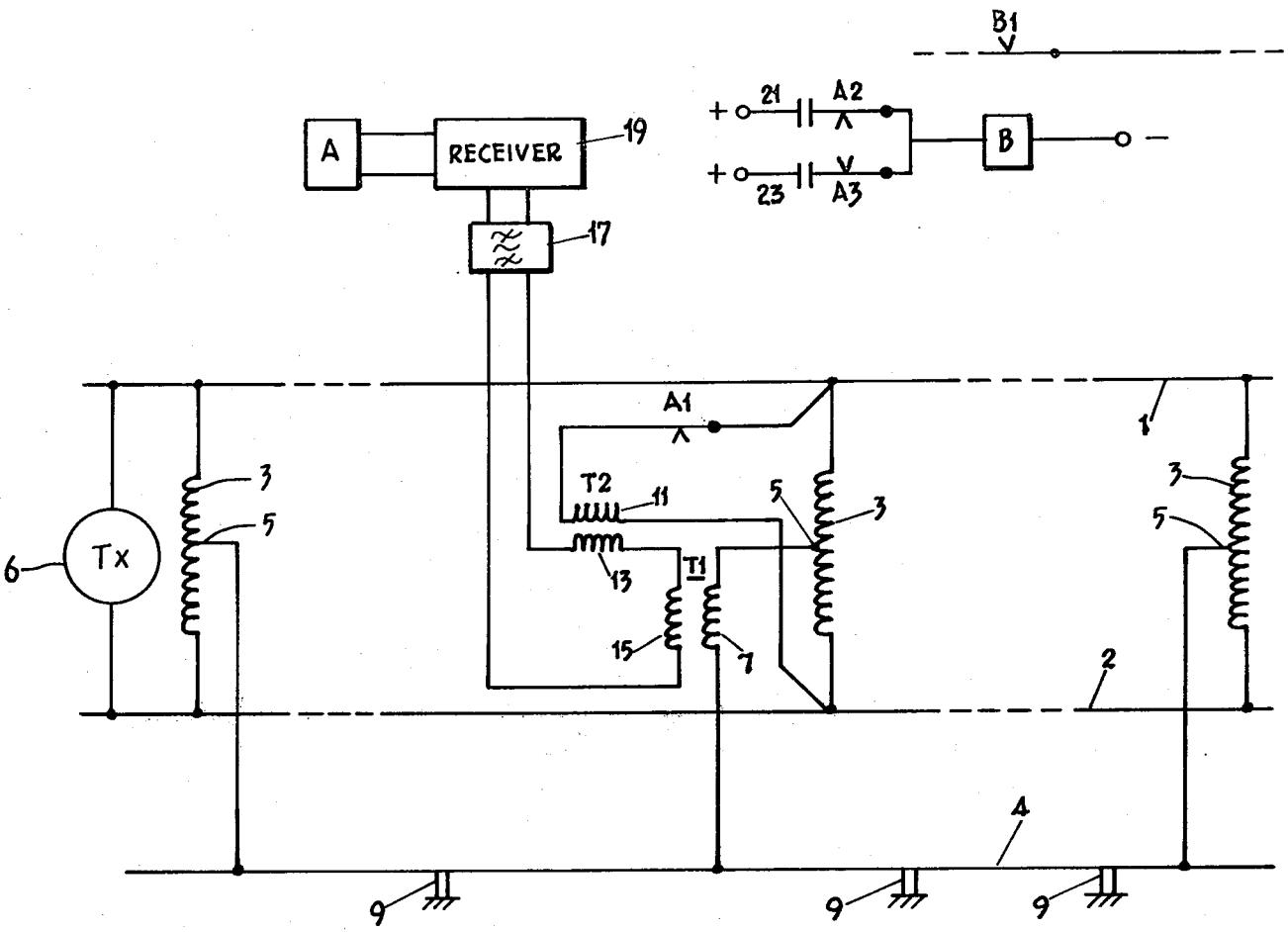
B1
B
A2
A3
21
23
A
RECEIVER
19
17
A1
T2
T1
11
13
15
7
1
2
3
4
5
6
9
Tx

BROKEN RAIL/BOND DETECTORS

FIELD OF THE INVENTION

The present invention relates to the detection of broken rails (or bonds) in a railway system employing 'double rail return' for traction currents and A.C. signalling for the detection of trains in particular track sections.

BACKGROUND

In double rail traction return systems, the traction current return is through both running rails in parallel. The rails may be continuous, or divided into sections for the purpose of determining train position. In the latter case the rail sections are separated by insulating block joints to isolate signal currents to particular sections. The insulating block joints are then bypassed for traction currents by impedance bonds having low impedance at the traction frequency. These bypass impedance bonds consist of (transverse) impedances connected between the rails on each side of the insulating block joint, centre taps of the two transverse impedances being commoned to bypass the insulating block joints.

In the case of continuous rails, impedance bonds between the rails are used to equalise the traction return currents at intervals. These impedance bonds are centre tapped and connected to a return conductor which is earthed and connected to support structures for the 'live' conductor of the traction supply.

For the purpose of determining the position of a train on the rails, A.C., particularly audio frequency, signals are fed along sections of the track from a transmitter connected between the rails to a tuned receiver similarly connected between the rails at a distance of the order of 1 km. A train within that track section, i.e. between the transmitter and receiver, will provide a sufficiently low impedance short circuit to short out the track signal before it reaches the receiver. A track relay held by the receiver when energised drops out to indicate occupancy of the section.

There are commonly several impedance bonds to each track circuit although they are normally positioned independently of the transmitter.

The presence of the above impedance bonds in double rail return systems causes difficulty in detecting a break in one of the rails. If a rail break occurs on the receiver side of an impedance bond the broken rail between that impedance bond and the next one in the receiver direction is in effect replaced by the earthed conductor between the centre taps of the two impedance bonds. In addition, the two impedance bonds, which are basically inductance coils, act as step-down and step-up auto-transformers respectively, so that a substantial part of the audio signal appears across the second impedance bond, and thus across the receiver.

Such a fault may very well not prevent the detection of a train in the track section since the train will tend to short circuit either the transmitter or the receiver according to the position of the train in relation to the break in the rail.

Similar remarks apply to an impedance bond with an "open" fault.

Consequently, it may be seen that a broken rail may go undetected until a derailment occurs.

An object of the present invention is therefore to provide a detection circuit for a double rail return system, capable of detecting a break in a rail or an open bond despite the bypassing effect of transverse impedance bonds.

SUMMARY OF THE INVENTION

In accordance with the invention a fault detecting circuit for use in a double rail return sub-system is associated with a track signal transmitter and receiver. The fault detecting circuit includes a back contact of a relay energized by the track signal receiver which derives track signal via a transformer or first means with a back contact of the relay in the energization circuit. Accordingly, in the absence of a fault the relay (or a second means) alternates, since when energized, it opens the receiver at its back contact. The alternating picking and dropping of the relay is then detected as the absence of a fault condition. In the presence of a fault, such as a broken rail or open bond, a fault track signal current circulates in the bond adjacent the receiver. A transformer (or third means), derives a current related to this fault identifying current which is summed with the track signal normally fed to the receiver. Since this latter signal is not interrupted by relay operation, it is used to inhibit relay alternation to thereby signal a fault.

According to the present invention, a fault detection circuit for use in a railway system employing double-rail traction-current return comprises an impedance bond connected between a pair of running rails, first means connected to said impedance bond, for detecting a track signal across said bond, second means responsive to said first means for operating to a distinctive condition in response to track signal detection by said first means, and third means responsive to track signal in said bond for inhibiting said operation of said second means.

BRIEF DESCRIPTION OF DRAWING

One embodiment of the invention is illustrated, by way of example, in the accompanying drawing.

DESCRIPTION OF PREFERRED EMBODIMENT

Running rails 1 and 2 carry the train and also serve, in parallel, as part of the earth return path for the traction motor current. The traction current is balanced between the two rails by periodic impedance bonds such as that referenced 3. The traction current return path is then enhanced by a return conductor 4, which is connected to a center tap 5 of each impedance bond 3 along the track. This latter connection is by way of the primary winding 7 of a transformer T1.

The return conductor 4 is connected to and supported by earthed structures 9.

An audio frequency transmitter 6 is connected between the running rails 1 and 2 at the end of a track section, and generates an audio frequency track signal in the rails 1 and 2, this track signal develops a significant track signal voltage across the impedance bond 3, which has a substantial impedance at the track signal frequency (although negligible impedance at the traction frequency).

The track signal voltage is picked off the impedance bond and applied to the primary winding 11 of a transformer T2 by way of a normally closed contact A1 of a relay A which is a conventional slow release relay.

The secondary winding 13 of transformer T2 is connected in series with the secondary winding 15 of transformer T1, the series output being applied to a bandpass filter 17, which excludes traction current and harmonics thereof, and then to a standard receiver 19 tuned to the track signal frequency.

The receiver output then feeds the relay A.

Two other contacts of relay A, i.e., A2 and A3 are normally open and normally closed respectively, and serve to connect respective charged capacitors 21 and 23 to a relay B. The capacitors 21 and 23 are connected to a D.C. source (indicated by the + characters in the FIGURE) and are charged up while their respective contacts A2 and A3 are open. If the contacts alternate at the proper rate relay B is maintained energized. Too slow or too rapid alteration is inadequate to pick or maintain relay B.

Under normal track conditions a track circuit voltage, produced by the track circuit transmitter 6, exists across the impedance bond 3 and this is fed to the primary winding of transformer T2 via a back contact A1 of relay A. On installation, this voltage is adjusted so as to be always sufficient to energize the receiver 19, when the track is unoccupied, and in this respect the equipment operates in a similar manner to a standard track circuit relay end. However, when the follower relay A is energized, its back contact A1 opens and disconnects the primary circuit of T2 thereby disconnecting the track circuit signal from the receiver 19. The follower relay 'A' will then deenergize, after a period of 0.75 second, or so, and contact A1 will close once more and reconnect the signal to T2. This cyclic action continues as long as the track is clear.

While relay A is repeatedly "picking" and "dropping", contacts A2 and A3 alternately make and break, and in so doing energize relay B by means of the well known fail-safe pulse decoding circuit including the capacitors 21 and 23. A contact, B1, or relay B may be used to control an indication circuit or may be included in the track repeater relay circuit, as is appropriate.

For the same reason that it is necessary to filter the large traction voltage components in a reed jointed track circuit receiver, it is also necessary in this case and this filtering is achieved by filter 17.

In the event of a fault condition, such as a broken rail or open circuit impedance bond in one half winding, the track circuit current will circulate via the "good" rail and conductor 4, for example and the center connection of the impedance bond 3 (which now may be regarded as the primary winding T1) and produce corresponding voltage across the secondary winding 15 of T1.

The signal from T1 secondary 15 will be in proportion to the track circuit voltage present across the track, as will the output from T2, and these two voltages may be adjusted on setting up the system with a simulated fault to be equal in magnitude and will remain so throughout track voltage variations. Depending upon the location of the rail break, in one or other of the rails, the outputs from the two transformers, T1 and T2, will either cancel, in which case the receiver will become deenergized, or they will be additive, and the receiver will remain energized. In either event the following relay A will cease switching and remain in only one state, and under these conditions Relay B will deenergize and remain so as long as relay A remains quiescent.

The rail/bond break detector does not in any way affect the operation of the track circuit. It may be used to advantage by extending the time taken for completion of the track repeater circuit when the B1 contact is included in the repeater control contact chain but this application would have to be given consideration against other factors. Since the driving power source for the detector is obtained from the track circuit signal it follows that the detector will release when the track is occupied by a train.

The decoding of pulses from the receiver may be achieved by an electronic equivalent of the relay decoder.

The invention may be seen as a broken rail/bond detection circuit for use in railway systems of the aforementioned kind, and comprising an impedance bond connected between the running rails, a tap connection to the impedance bond, means for detecting a track signal existing across the impedance bond, cyclic switching means responsive to the detected track signal to perform cyclic operation, means for detecting a track signal arising at the tap connection following a break in a running rail, this tap connection signal being arranged to inhibit operation of the cyclic switching means and thus provide a fault indication.

The cyclic switching means may be held in one or another of two states according to the position of the fault.

What is claimed is:

1. A circuit for detecting faults in a traction current return sub-system using a double rail return comprising an impedance bond (3) connected between a pair of running rails (1,2), first means (11,13), connected to said impedance bond, for detecting a track signal across said bond, second means (17,19, A,A1), responsive to said first means, for operating to a distinctive condition in response to track signal detection by said first means and, third means (5,7,15) responsive to a fault track signal in said bond for inhibiting said operation of said second means.

2. The apparatus of claim 1 in which said second means includes means to interrupt said first means whereby said distinctive condition of said second means is a repetitive cycling.

3. The apparatus of claim 1 in which said third means includes a tap on said impedance bond.

4. The apparatus of claim 2 in which said third means provides a track signal to override said means to interrupt or to interfere with said second means.

5. The apparatus of claim 1 in which said first means comprises a first transformer connected across said impedance bond, said second means comprises a filter and tuned receiver and relay operating coil, with a back contact of said relay operating coil in series with a winding of said first transformer, and said third means comprises a second transformer connected between a tap of said impedance bond and an earth return, said second transformer having a winding in a series circuit with a different winding of said first transformer, said series circuit being connected as an input to said filter and tuned receiver, whereby, in the absence of a fault, a track signal detected across said impedance bond coupled through said filter and track receiver energizes said relay operating coil to open said back contact thus interrupting said circuit including said first transformer and in the presence of a fault, a track signal flowing in said bond induces energy into said second transformer to either maintain said relay operating coil energized even with said back contact open or to inhibit energization of said relay operating coil with said back contact closed.

6. The apparatus of claim 1 or 5 in which said fault is a broken rail.

7. The apparatus of claim 1 or 5 in which said fault is an open impedance bond.

* * * * *